United States Patent [19]

Krug et al.

[11] Patent Number: 5,051,163

[45] Date of Patent: Sep. 24, 1991

[54] NITROGEN-TOLERANT CRACKING PROCESS

[75] Inventors: Russell R. Krug, Novato; Jarold A. Meyer, Martinez, both of Calif.

[73] Assignee: Chevron Research Company, San Francisco, Calif.

[21] Appl. No.: 463,043

[22] Filed: Jan. 11, 1990

[51] Int. Cl.[5] ..... C10G 25/00; C10G 13/00

[52] U.S. Cl. ..... 208/88; 208/91; 208/113; 208/121; 208/85

[58] Field of Search ..... 208/85, 91, 88

[56] References Cited

U.S. PATENT DOCUMENTS

| | | | |
|---|---|---|---|
| 2,414,973 | 1/1947 | Nelson | 208/91 |
| 2,605,214 | 7/1952 | Galstaun | 208/91 |
| 2,925,375 | 2/1960 | Fleck et al. | 208/91 |
| 2,954,338 | 9/1960 | Carmody | 208/91 |
| 3,063,933 | 11/1962 | Meinew | 208/91 |
| 3,189,539 | 6/1965 | Sieg | 208/91 |
| 3,639,228 | 2/1972 | Carr et al. | 208/75 |
| 4,071,435 | 1/1978 | Smith | 208/91 |
| 4,081,351 | 3/1978 | Hernemann | 208/90 |
| 4,090,951 | 5/1978 | Smith | 208/91 |
| 4,719,003 | 1/1988 | Shihahi | 208/91 |
| 4,783,566 | 11/1988 | Kocal et al. | 208/135 |
| 4,921,946 | 5/1990 | Kocal et al. | 585/467 |

*Primary Examiner*—Helane E. Myers

[57] ABSTRACT

A process is disclosed for reducing the impact of basic compounds, such as nitrogen, on hydrocarbonaceous feed intended for catalytic cracking. In a preferred embodiment, a portion of the regenerated catalyst of a catalytic cracking process is separated and contacted with the hydrocarbonaceous feed at a temperature and for a time sufficient to strongly bind the basic contaminants in the feed with the separated portion of the acid catalyst. The feed is then passed to the catalytic cracking reactor in a slurry with the separated catalyst, resulting in a desirable conversion increase.

25 Claims, 1 Drawing Sheet

NITROGEN-TOLERANT CRACKING PROCESS

This invention relates to a process for reducing the effects of catalyst deactivating basic compounds, such as containing nitrogen, in a cracking process, especially a fluid catalytic cracking (FCC) process.

BACKGROUND OF THE INVENTION

Various hydrocarbonaceous feeds, including petroleum distillates and hydrocarbonaceous liquids obtained from coal, tar sands, and oil shale contain sufficient quantities of nitrogen-containing compounds to limit the performance of acid catalytic refining processes. Nitrogen-containing molecules tend to be basic and can poison or neutralize acid sites on the cracking catalysts. Neutralization of acid sites significantly reduces the catalyst's ability to convert heavier feeds to more desirable lighter liquid products, such as gasoline and diesel fuel. This problem is significantly more difficult among feeds from the West Coast of the United States, since these feeds often contain higher amounts of these nitrogen-containing compounds. It would be advantageous if there were a method to prevent or deter this neutralization in an efficient manner, without expensive additional equipment or other materials being introduced into the system. For fluid catalytic cracking processes, it would be especially advantageous for the process to be low-pressure, and non-hydrogen consuming. The present invention seeks to provide such a process.

The prior art has addressed a number of ways for dealing with the nitrogen-poisoning problem in fluid catalytic cracking processes. As discussed in "Fluid Catalytic Cracker Catalyst Design for Nitrogen Tolerance", G. W. Young, *Journal of Physical Chemistry* (Vol. 90, 1986), pp. 4894–4900, the work of Mills et al, *Journal of American Chemical Society* (Vol. 72, 1950) pp. 1554, demonstrates the ability of organic nitrogen compounds to severely affect the activity of cracking catalysts under ordinary cracking conditions. Among the compounds studied which demonstrate catalyst-poisoning effects are quinaldine, quinoline, pyridine, piperidine, decyclamine, analine acridine, carbazole, naphthylamine, dicyclohexylamine, and pyrrole. As discussed in Young, refiners have traditionally attempted to deal with high nitrogen feeds in a number of ways. These methods include: (a) hydrotreating, (b) acid treatment to remove basic nitrogen compounds, (c) injecting acid into the feed, (d) changing the process conditions, for example, increasing reaction temperature or the severity, i.e., the catalyst to oil ratio, (e) blending feedstocks to limit the concentration of nitrogen compounds, and (f) using more active catalysts.

The present invention seeks to provide an additional method to reduce the impact of nitrogen poisons in the feed. Specifically, it provides a mechanism by which a portion of the circulating inventory of the active acid catalyst of a catalytic cracking process is contacted with the feed prior to the feed entering the catalytic reaction zone. This initial contacting allows for much of the nitrogen to bind with a minority of acid sites within the entire inventory, and thereby hinder catalyst poisons from interfering with the main reactions of the process.

This process occurs at a temperature and for a time sufficient to strongly bind some or all of the reactive nitrogen contaminants to the separated portion of the catalyst. By "sacrificing" a minority of the acid sites of the entire inventory to bind with much of the nitrogen, the now nitrogen-reduced feed passes through the reactor with the majority of catalyst free to perform cracking relatively unhindered by the bound nitrogen poisons. Nitrogen can bind with acid catalyst surfaces in different ways. For example, a low-energy bond is formed primarily by physical adsorption. This bond or association can be made at low temperatures, but allows nitrogen molecules to come off the surface easily and migrate to titrate active sites, of perhaps even greater activity, elsewhere.

A stronger bond is formed by chemical adsorption, also termed chemisorption. A chemisorption bond has greater binding strength than the relatively weak physical adsorption bond, and therefore prevents bound nitrogen-containing molecules from migrating to other sites. We have found the temperature range of 450° -850° F. most effective for binding nitrogen-containing molecules to cracking catalysts. Experiments have also shown that the binding effect can be used to pre-concentrate nitrogen molecules in the cracking process to free other catalyst from this poison, thereby resulting in higher yields of conversion products. Higher temperatures than specified above result in cracking, leaving nitrogen in smaller molecules, which can rapidly migrate between sites. While the present process is particularly appropriate for high nitrogen feeds, i.e. those containing over 1000 ppm nitrogen, it can also be advantageously used feeds containing lower amounts.

Relevant Art

U.S. Pat. No. 3,639,228, Carr et al, involves a sequential contacting process somewhat similar to that of the present invention. Catalyst is sequentially split into portions which are introduced into the reactor. All of the feed is contacted internally in the reaction zone in a high cracking temperature thermal range, and their initial contacting is conducting under cracking conditions sufficient to produce a first portion of gasoline product. The process does not address denitrification nor the chemisorption at the unique temperature range of the present invention.

U.S. Pat. No. 4,090,951, Smith, discloses a process for denitrifying syncrude feed obtained from, for example, oil shale, tar sands or coal. The syncrude is first mixed with a low temperature absorber, either in the feed stream or in a holding tank, to physically absorb high nitrogen components. The feed is separated into a high nitrogen and a low nitrogen portion and only the high nitrogen portion is catalytically cracked. Additionally, all of the catalyst is contacted with the feedstream and there is no sacrificial portion, as in the present invention.

U.S. Pat. No. 4,081,351, Heinemann, discloses a process for denitrifying solubilized coal fractions. The feed is denitrified before it enters the catalytic cracking unit. The absorbent used for denitrification, however, is not available as the catalyst for the process itself.

SUMMARY OF THE PRESENT INVENTION

The present invention comprises a catalytic cracking process employing a circulating inventory of acid catalyst, wherein the catalyst is circulated between a catalytic reaction zone and a regeneration zone, and the catalyst is regenerated in said regeneration zone. The process comprises separating a portion of the circulating catalyst inventory coming from the regeneration zone; contacting all or part of a hydrocarbonaceous feed containing basic contaminants with the separated portion of the circulating catalyst inventory in a precontacting zone at a temperature and time sufficient to strongly bind some or all of the basic contaminants to the separated portion of the catalyst; and passing the separated portion, the precontacted hydrocarbonaceous feed, and the remainder of the circulating catalyst inventory to the reaction zone. Among other factors, the present invention provides means for reducing the catalyst poisoning effects of basic compounds in hydrocarbon feed by using a portion of the acid catalyst itself to bind these poisons, and leaves the majority of the catalyst free to crack feed relatively free of basic poisons. cl

BRIEF DESCRIPTION OF THE DRAWING

The Figure is a schematic representation of a preferred embodiment of the present invention showing the precontacting zone and a portion of the regenerated catalyst being introduced into the zone with the feed.

DETAILED DESCRIPTION OF THE INVENTION

Figure 1:
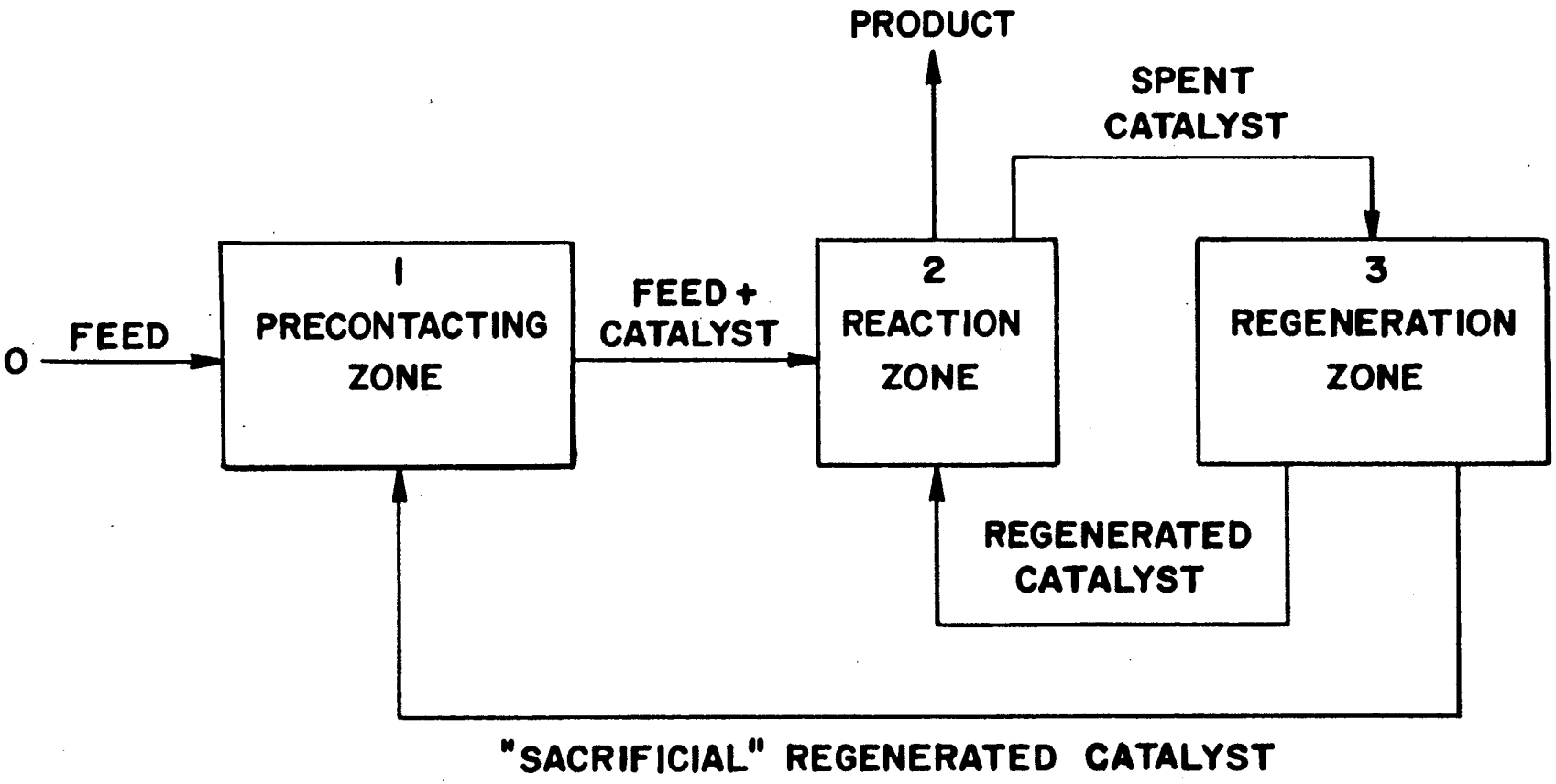

The present invention provides a process integrated method for neutralizing the deleterious effects of basic compounds, especially nitrogen, in a hydrocarbonaceous feed to a catalytic cracking process. The feed is first contacted with a minor "sacrificial" portion of the circulating inventory of a fluid catalytic cracking process, thereby permitting poisonous basic compounds to be bound strongly with a minority of the entire circulating inventory. While many of the acid sites on the sacrificial portion of the catalyst are bound to or neutralized by the basic compounds, and are therefore unavailable for catalytic cracking of feed in the reaction zone, by sacrificing themselves and strongly binding to basic compounds within the system, they permit the majority of the circulating catalyst inventory to be relatively uncontaminated and more readily available for catalytic cracking of the remaining feed. This results in an increase of conversion of heavy oil to more desirable lighter products, such as gasoline or diesel fuel.

The process of forming a strong chemical bonding, referred to herein as chemisorption, is temperature-dependent. By employing a temperature appropriate to facilitating chemisorption, the strongest binding of the nitrogen compounds to the acid site of the sacrificial portion of the catalyst is achieved. It has been found that the appropriate temperature range for chemisorption of organic nitrogen-containing molecules is between 450° F. and 850° F.

Feedstock

The present invention is applicable to any hydrocarbonaceous feedstock containing basic compounds, especially those containing nitrogen. These feedstock can include crude petroleum, especially those from particular sources having high nitrogen, for example, those of the western coast of the United States, such as Kern River or San Joaquin Valley fields. Additionally, distillates, gas oils, atmospheric or vacuum residua or solvent deasphalted oils derived from these crudes, may also have similar unacceptable high levels of nitrogen. It is contemplated, however, that feeds with lower nitrogen levels are also beneficiated to an even greater percentage of nitrogen removal when treated at the same conditions as high nitrogen stocks. It is within the contemplation of the invention that other hydrocarbonaceous feedstocks containing undesirable amounts of nitrogen, may be beneficially processed according to the present invention. Other feedstocks can include shale oil, liquefied coal, beneficiated tar sands, etc.

Preferred Embodiment of the Process

In a preferred embodiment of the present invention, the feed is mixed in a precontacting zone with a portion of the regenerated circulating catalyst inventory of a fluid catalytic cracking unit to form a slurry of feed and catalyst. The contacting occurs at a temperature sufficient to strongly bind some or all of the nitrogen contaminants in the feed to acid sites on the catalyst. The feed and sacrificial catalyst, onto which are strongly bound basic compounds form this feed, then passes as in a slurry to the catalytic cracking reactor. This process results in strong binding of nitrogen-containing molecules to the catalyst by a process believed to be chemisorption. This occurs at a temperature between 450° F. and 850° F., and more preferably between 600° F. and 750° F. Below about 450° F., nitrogen-containing compounds are not strongly bound to the catalyst within reasonable times for a commercially viable precontacting zone. Above 850° F., thermal cracking or visbreaking begins, which can release nitrogen back into the system. More particularly, for the purposes of the strongly bound mechanism, most hydrocarbonaceous feeds start to decompose at around 650° F. This suggests that the bonds of the organic nitrogen-containing compounds comprising the feed become active and begin to react. It is the advantage of the present invention that we provide those nitrogen compounds with material with which to form chemisorption bonds.

The time sufficient for this precontacting to strongly bind nitrogen-containing organic contaminants to acid sites on the catalyst is anywhere from between approximately one second to 30 minutes. More preferred is between about one minute and 20 minutes, and most preferably, between one and five minutes. There is, however, a time versus temperature functional relationship, i.e. the greater the temperature, the less contacting time needed to strongly bind the contaminants.

The heat needed to raise the temperature of the feed to an appropriate level may be supplied by the catalyst itself as it comes from the regenerator. Appropriate regenerator temperatures are ordinarily in the range of 1100° to 1300° F. The necessary heat may also come from the feed from its source and the feed preheater. Depending on source feed temperature, and regenerated catalyst temperature and rates of feed and catalyst, the heat of the catalyst may be sufficient when mixed with the feed in the precontacting zone to provide the necessary temperature increase without the use of a feed preheater.

The efficiency of the process is ordinarily also a function of the weight ratio of the catalyst to the feed. In its broadest range, the catalyst to oil ratio in the contacting zone be from about one part catalyst to 20 parts feed up to about four parts catalyst to one part feed. This means that the amount of the circulating catalyst inventory constituting the sacrificial portion can be from approximately 0.1% of the entire circulating inventory to approximately 50%, by weight. The preferred range is a catalyst-to-oil ratio of 1:5 to 2:1, or 10% to 25% by weight of the circulating catalyst inventory.

The sacrificial portion of the circulating catalyst inventory can be separated from the entire circulating catalyst inventory by any conventional means, such as metering, for example, controlled to pressure drop across a slide valve. The metering can also be used to control the precontacting zone temperature to a level optimal for chemisorption in the precontacting zone.

It is preferred that the precontacting zone immediately precede the FCC reaction zone or riser. Alternatively, the precontacting might follow the usual feed furnace for the FCC process or the precontacting zone might be the feed furnace itself. At sufficiently high catalyst rates to the precontacting zone, no feed furnace would be required, since sufficient heat would be carried by the regenerated catalyst.

When sacrificial catalyst is charged to the feed upstream of the feed furnace, normal furnace operations can be used to control precontacting temperatures. Although this may give rise to potential plugging of the furnace tubes, it does obviate the necessity for a holding tank or other mechanism as in a separate precontacting zone. It is preferred that the flow of the hydrocarbon feeds through the precontacting zone be as close to plug flow as possible, and it is contemplated that the use of internals, preferably baffles, may be used to facilitate plug flow. It is also preferable that the pressure within the precontacting zone be sufficient to maintain the appropriate flow rate of catalyst into the zone. In a preferred embodiment, this can be somewhat less than 2 ATM psig.

It is also within the contemplation of the invention that the contacting may occur sequentially, that is, catalyst may be added to the precontacting zone in steps to gain sequential contacting benefits. In particular, sequential contacting has been demonstrated to reduce gas oil nitrogen levels advantageously.

Catalyst

The catalysts finding most effective use in the present invention are acid catalysts. These catalysts are particularly affected by the neutralizing effects of basic organic compounds in feedstocks. Those finding most particular use comprise solid crystalline catalysts selected from the group consisting of X-zeolites, Y-zeolites, rare earth or hydrogen exchanged X- and Y-zeolites, Beta-zeolites, ZSM-zeolites, silicalites, silica-alumina phosphates and magnesium aluminum phosphorus oxides, crystalline alumina, or mixtures thereof. The preferred catalyst is Y-zeolites, or mixtures of Y-zeolites and other catalysts in the above group. Another group of acid catalysts finding use in the present invention includes solid amorphous catalysts selected from the group consisting of amorphous silica-alumina, phosphorus-containing amorphous silica-alumina, phosphorus-containing amorphous alumina, alumina silicates, and phosphorus-containing alumina silicates, alumina and silica. The preferred amorphous catalyst is alumina silicates.

As discussed above, the reaction zone finding most appropriate use in the present invention comprises a reactor selected from the group consisting of upflow and downflow risers, moving bed reactors, and horizontal transfer lines. The preferred reactor mechanism is an upflow riser. Besides fluid catalytic cracking, the present invention may also be applicable to other types of cracking processes, including moving bed and Houdry.

As discussed above, it is preferred that most of the heat necessary to provide the sufficient temperature to bind the nitrogen compounds to the acid catalyst in the contacting step be provided by the regenerating catalyst itself. However, it is also within the contemplation of the present invention that there may be an additional heating zone prior to the contacting step or zone wherein the feed is heated to a sufficient temperature to supplement heat carried with the sacrificial catalyst to permit chemisorption of basic compounds on the acid catalyst.

It is also within the contemplation of the invention that the process includes the use hydrocarbonaceous stocks from more than one source, wherein the stocks with higher levels of basic compounds are precontacted and the stocks with lower levels of basic compounds are charged directly to the reactor along with the precontacted slurry.

The following examples are intended to be illustrative of the present invention, and are not intended to limit the invention beyond that which is found in the claims.

EXAMPLES

EXAMPLE 1

FCC gas oil feed was reacted in a precontacting step with commercial regenerated FCC catalyst for 20 minutes at 650° F. at two different catalyst-to-oil ratios, as shown in Table 1A. Oil was then separated from the catalyst by filtration.

Oil from the precontacting step was then tested with calcined rare earth Y zeolite FCC equilibrium catalyst in a standard Micro Activity Test (MAT) at 960° F. (516° C.) reaction temperature, 16 weight hourly space velocity (WHSV), and a catalyst-to-oil ratio of 7.0.

Data in Table 1A show the nitrogen remaining in the gas oil was reduced by this precontacting step. Moreover, the data in Table 1B show that increasing the relative amount of catalyst in the precontacting stage increased the reactivity of the feed to be converted to naphthas and light cycle oil.

TABLE 1

FCC FEED BENEFICIATION BY PRECONTACTING

| | | | |
|---|---|---|---|
| A. Precontacting Step - Regenerated FCC Equilibrium Catalyst (650° F. for 20 min.) | | | |
| Catalyst/Oil, wt/wt[1] | 0 | 1/5 | 1/1 |
| Nitrogen, ppm[2] | 3575 | 3105 | 2473 |
| % Denitrification | base | 13 | 31 |
| B. MAT Results (wt. %) (960° F. at 16 WHSV and 7 cat/oil) | | | |
| 430−° F., conversion | 45.6 | 48.8 | 55.6 |
| 650−° F., conversion | 67.7 | 72.6 | 81.3 |
| Coke | 3.4 | 3.5 | 3.5 |
| $C_2$− | 1.5 | 1.5 | 1.4 |
| $C_3 + C_4$ | 8.1 | 8.8 | 9.6 |
| Light Naphtha | 15.0 | 16.3 | 18.5 |
| Heavy Naphtha | 17.6 | 18.7 | 22.6 |
| Light Cycle Oil | 22.1 | 23.8 | 25.7 |
| Heavy Cycle Oil | 32.3 | 27.4 | 18.7 |

[1]Cat/Oil ratio in the pre-riser contacting stage.
[2]Nitrogen content of oils leaving precontacting step before testing for MAT activity.

EXAMPLE 2

In a second test, FCC gas oil was contacted with regenerated FCC equilibrium catalyst in the precontacting step described in Example 1.

Oils from the precontacting step were then cracked using the standard MAT test described in Example 1. However, the catalysts used in the MAT test were a mixture of catalysts from the precontacting step plus sufficient calcined FCC equilibrium catalyst to give a catalyst-to-oil ratio of 7.0, as might occur in a commercial FCC unit.

Results shown in Table 2 indicate that higher catalyst/oil ratios in the precontacting step again result in higher MAT conversions. The most surprising and significant aspect of these conversion increases is that they came with no additional coke or $C_2^-$ gas yield. Conventional methods for FCC yield improvement include increasing catalyst rate, increasing reaction temperature and/or increasing catalyst activity. These methods generally increase coke yield, and/or gas yield, both of which are of low value. Thus, the yield increase of our new process, which give no increase of coke or gas, are very attractive.

TABLE 2

DEMONSTRATION OF THE INTEGRATED PROCESS

| | | | |
|---|---|---|---|
| A. Precontacting Step - Regenerated FCC Equilibrium Catalyst (650° F. for 20 minues) | | | |
| Cat/Oil, wt/wt | 0 | 1/5 | 1/1 |
| Nitrogen, ppm | 3575 | 3105 | 2473 |
| % Denitrification | base | 13 | 31 |
| B. MAT Results, wt. % (960° at 16 WHSV and 7 cat/oil) | | | |
| 430−° F., conversion | 45.6 | 46.5 | 51.6 |
| 650−° F., conversion | 67.7 | 70.4 | 77.9 |
| Coke | 3.4 | 3.5 | 3.4 |
| $C_2-$ | 1.5 | 1.4 | 1.3 |
| $C_3 + C_4$ | 8.1 | 8.0 | 8.6 |
| Light Naphtha | 15.0 | 15.1 | 17.2 |
| Heavy Naphtha | 17.6 | 18.4 | 21.1 |
| Light Cycle Oil | 22.1 | 24.0 | 26.3 |
| Heavy Cycle Oil | 32.3 | 29.6 | 22.1 |

EXAMPLE 3—SEQUENTIAL CONTACTING

Catalyst may be added to the precontacting zone in steps to gain sequential contacting benefits. In this example, FCC gas oil was contacted with regenerated FCC equilibrium catalyst at 650° F. and a 1:1 catalyst-to-oil ratio by weight. After 20 minutes, the catalyst was filtered from the oil. Nitrogen levels were measured and the oil was then contacted again at identical conditions. These treatments were repeated six times. The results are summarized in Table 3. Sequential contacting was demonstrated to reduce gas oil nitrogen levels advantageously.

TABLE 3

SEQUENTIAL CONTACTING

| Treatment | Initial Nitrogen, ppm | Final Nitrogen, ppm | Percent Denitrification |
|---|---|---|---|
| 1 | 3376 | 2750 | 19 |
| 2 | 2750 | 2100 | 24 |
| 3 | 2100 | 1550 | 26 |
| 4 | 1550 | 1200 | 23 |
| 5 | 1200 | 1000 | 17 |
| 6 | 1000 | 800 | 20 |

What is claimed is:

1. A catalytic cracking process employing a circulating inventory of acid catalyst, wherein the catalyst is circulated between a catalytic reaction zone and a regeneration zone and the catalyst is regenerated in the regeneration zone, said process comprising:

separating a minor sacrificial portion of the entire circulating catalyst inventory coming from the regeneration zone;

contacting hydrocarbonaceous feed containing a basic contaminants with the sacrificial portion of the entire circulating catalyst inventory in a precontacting zone at a temperature and for a time sufficient to remove some or all of the basic contaminants to the sacrificial portion of the catalyst;

passing the sacrificial portion, the precontacted hydrocarbonaceous feed, and the remainder of the circulating catalyst inventory to the catalytic reaction zone under cracking conditions.

2. The processes claimed in claim 1, wherein the temperature in the precontacting zone which is sufficient to remove the basic contaminants from said hydrocarbonaceous feed to the sacrificial portion of the catalyst is in the range between about 450° F. and 850° F.

3. The process as claimed in claim 2, wherein the temperature is in the range between about 600° F. and 750° F.

4. The process as claimed in claim 3, wherein the temperature is in the range between about 650° F. and 700° F.

5. The processes claimed in claim 1, wherein the time in the precontacting zone which is sufficient to remove the basic contaminants from said hydrocarbonaceous feed to the sacrificial portion of the catalyst is between about 1 second and about 30 minutes.

6. The process as claimed in claim 5, wherein the time is between about 1 minute and 5 minutes.

7. The process as claimed in claim 1, wherein the weight ratio of catalyst to hydrocarbonaceous feed in the precontacting step is between 1:20 and 4:1.

8. The process as claimed in claim 7, wherein the weight ratio is between 1:5 and 2:1.

9. The process as claimed in claim 1, wherein the sacrificial portion of the circulating catalyst inventory comprises about 0.1 weight percent to 50 weight percent of the entire circulating inventory.

10. The process as claimed in claim 9, wherein the portion is from 1 weight percent to about 25 weight percent of the entire circulating inventory.

11. The process as claimed in claim 1, wherein the acid catalyst comprises solid crystalline catalyst selected from the group consisting of X zeolites, Y zeolites, rare-earth or hydrogen exchanged X and Y zeolites, beta zeolites, ZSM zeolites, silicalites, silica alumina phosphates and magnesium aluminum phosphorus oxides, crystalline alumina, or mixtures thereof.

12. The process as claimed in claim 11, wherein the acid catalyst comprises Y zeolites, either rare earth or hydrogen exchanged.

13. The process as claimed in claim 1, wherein the acid catalyst comprises solid amorphous catalyst selected from the group consisting of amorphous alumina, silica, silica-alumina, phosphorus-containing amorphous silica-alumina, phosphorus-containing amorphous alumina, alumina silicates, and phosphorus-containing alumina silicates.

14. The process as claimed in claim 13 wherein the acid catalyst comprises alumina silicates.

15. The process as claimed in claim 1, wherein the catalytic cracking process comprises a process selected from the group consisting of fluid catalytic cracking, moving bed, and Houdry.

16. The process as claimed in claim 15, wherein the catalytic cracking process comprises fluid catalytic cracking.

17. The process as claimed in claim 1, wherein the basic contaminants comprise organic nitrogen-containing compounds.

18. The process as claimed in claim 17, wherein the compounds comprise compounds selected from the group consisting of aromatic and aliphatic nitrogen-containing compounds.

19. The process as claimed in claim 1 wherein the reaction zone comprises a reactor selected from the group consisting of upflow and downflow risers, moving bed reactors, and horizontal transfer lines.

20. The process as claimed in claim 19, wherein the reaction zone comprises an upflow riser.

21. The process as claimed in claim 1, wherein the heat necessary to provide the sufficient temperature in the contacting zone is provided by the regenerated catalyst itself.

22. The process as claimed in claim 1, wherein the heat necessary to provide the sufficient temperature in the contacting zone is provided by passing the feed and catalyst mixture through a furnace.

23. The process as claimed in claim 1, wherein the precontacting with catalyst is conducted by the sequential addition of regenerated catalyst to the feed stream.

24. The process as claimed in claim 1, wherein the hydrocarbonaceous feedstock is selected from the group consisting of crude petroleum, petroleum distillates, vacuum gas oil, atmospheric or vacuum residua, deasphalted oils from such feedstocks, shale oil, liquefied coal, and tar sand effluent.

25. The process as claimed in claim 1, wherein the feed comprises hydrocarbonaceous stocks from more than one source having varying levels of basic compounds, wherein the stocks with higher levels of basic compounds are precontacted and the stocks with lower levels of basic compounds are charged directly to the reactor, along with the effluent from the contacting zone.

* * * * *